US007837527B2

(12) United States Patent
Debby

(10) Patent No.: US 7,837,527 B2
(45) Date of Patent: Nov. 23, 2010

(54) FLOATING ISLAND

(75) Inventor: Yael Debby, Mevashert Tzion (IL)

(73) Assignee: Nuvo Group Ltd., Modiin (IL)

( * ) Notice: Subject to any disclaimer, the term of this patent is extended or adjusted under 35 U.S.C. 154(b) by 0 days.

(21) Appl. No.: 11/775,271

(22) Filed: Jul. 10, 2007

(65) Prior Publication Data

US 2008/0308029 A1 Dec. 18, 2008

Related U.S. Application Data

(60) Provisional application No. 60/929,072, filed on Jun. 12, 2007.

(51) Int. Cl.

| | |
|---|---|
| ***B63C 9/08*** | (2006.01) |
| ***B63C 9/28*** | (2006.01) |
| *B63B 9/04* | (2006.01) |
| *B63B 35/58* | (2006.01) |

(52) U.S. Cl. ..... 441/129; 441/35

(58) Field of Classification Search ..... 441/1, 441/35, 129, 131, 136

See application file for complete search history.

(56) References Cited

U.S. PATENT DOCUMENTS

| | | | | | |
|---|---|---|---|---|---|
| 5,570,480 | A | * | 11/1996 | Yeung | 4/487 |
| D489,426 | S | * | 5/2004 | Oakley | D21/803 |
| D504,488 | S | * | 4/2005 | Peterson | D21/835 |

FOREIGN PATENT DOCUMENTS

| | | |
|---|---|---|
| WO | WO9109657 | 7/1991 |

* cited by examiner

*Primary Examiner*—Daniel V Venne
(74) *Attorney, Agent, or Firm*—Mark M. Friedman

(57) ABSTRACT

The present invention is a floating island (FI), which is a buoyant apparatus for a watery environment such as, for example a swimming pool. The FI may be designed as a playful apparatus enabling users to safely climb upon the FI. The FI may be designed especially, yet not exclusively, for users such as children, toddlers and the like. The FI may comprise a buoyant-section that may be separated and sealed from a weight-section. The weight-section may be a hollow cavity walled by a substantially solid material, where the weight section's walls may comprise upper and lower holes to allow water enter and exit the chamber like cavity in the weight-section and function as a dynamic weight. The buoyant-section may allow floating of the FI.

6 Claims, 2 Drawing Sheets

FLOATING ISLAND

CROSS-REFERENCE TO RELATED APPLICATIONS

This application claims the benefit under 35 U.S.C. §119(e) of U.S. Provisional Patent Application No. 60/929,072 filed on Jun. 12, 2007, the content of which is incorporated by reference herein.

FIELD OF THE INVENTION

The present invention generally relates to the field of floating apparatuses. More particularly, the present invention relates to floating apparatuses for a watery environment.

BACKGROUND OF THE INVENTION

There are many playing apparatuses for children as well as for grownups for watery environments such as the sea, swimming pools and the like. Most of the play and/or exercise apparatuses for watery environment that allow users to apply forces upon them (such as allow users to climb upon) require some sort of attachment to the ground or any other stable support. Alternatively, apparatuses that allow users to climb upon are usually made of heavy, stable and non-buoyant materials to allow the apparatuses to sink and act like a "mountain island" inside the water.

Many apparatuses aimed to carry weight in water use weights positioned in various locations of the apparatus, to stabilize the construction but this is mostly inefficient in cases where additionally to waves and the like, much stronger forces are applied upon the apparatus from different direction such as in a case of climbing user—where the users use the apparatus for climbing exercise and play.

A patent application number WO9109657 by Dahlgren Lennart discloses a water toy, especially a boat, comprising a hollow hull having a bottom preferably designed as a keel and a ballast in the keel. The weight of the ballast is not big enough to make the boat stable when placed in water, but it will tip over and float aslant. The hollow hull is provided with water inlet holes through which water enters when the boat floats aslant, at which the additional weight of the water in the hull, will cause the boat to raise to an upright floating position. Lennart's boat toy is not purposed to respond to any additional external force other than the initial tilting that allows a portion of water to enter through the holes to allow the toy to straighten upright.

SUMMARY OF THE INVENTION

The present invention is a floating island (FI), which is a buoyant apparatus for a watery environment such as, for example a swimming pool. The FI may be designed as a playful apparatus enabling users to safely climb upon the FI. The FI may be especially yet not exclusively designed for users such as children, toddlers and the like.

The FI may comprise a buoyant-section that may be separated and sealed from a weight-section. The weight-section may be a hollow cavity walled by a substantially solid material, where the weight section's walls may comprise upper and lower holes to allow water enter and exit the chamber like cavity in the weight-section. The buoyant-section may be buoyant and allow floating of the FI.

According to embodiments of the present invention, by allowing waters enter and exit the weight-section's cavity—the weight-section may function as a dynamic weight when the users of the FI climb the FI or apply any tilting and drowning forces upon the FI. The water entering and exiting the cavity in response to the tilting forces applied by the users may be used to balance the stability of movement of the FI, preventing the FI from turning over.

According to embodiments of the present invention, the FI may be designed according to an designated age group. For example, the size, weight and shape may be designed to fit climbing users of the age range of 2-5 years old toddlers. Additionally, the number of users within the allowed age group that may be allowed to climb the FI at the same time may be limited according to safety regulations.

BRIEF DESCRIPTIONS OF THE DRAWINGS

The subject matter regarded as the invention will become more clearly understood in light of the ensuing description of embodiments herein, given by way of example and for purposes of illustrative discussion of the present invention only, with reference to the accompanying drawings, wherein FIG. 1 is an isometric top view of a floating island, according to some embodiments of the present invention, FIG. 2 is a bottom view of a floating island, according to some embodiments of the present invention.

Figure 1:
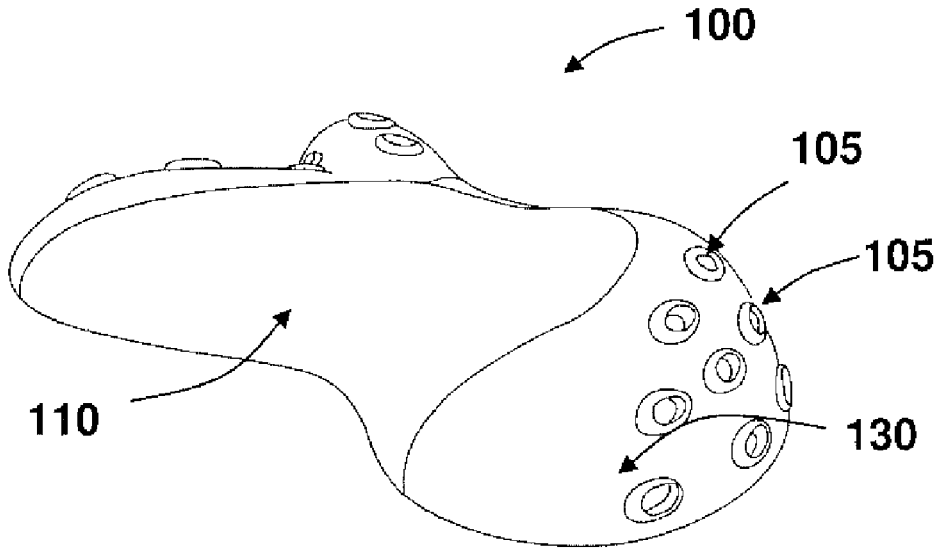

The drawings together with the description make apparent to those skilled in the art how the invention may be embodied in practice.

An embodiment is an example or implementation of the inventions. The various appearances of "one embodiment," "an embodiment" or "some embodiments" do not necessarily all refer to the same embodiments. Although various features of the invention may be described in the context of a single embodiment, the features may also be provided separately or in any suitable combination. Conversely, although the invention may be described herein in the context of separate embodiments for clarity, the invention may also be implemented in a single embodiment

DETAILED DESCRIPTIONS OF SOME EMBODIMENTS OF THE INVENTION

The present invention is a floating island (FI) 100, which may be a buoyant apparatus for a watery environment. FI 100 may comprise a buoyant-section 140 and a weight-section 130, which may be substantially separated from the buoyant section 140. Weight-section 130 may be a hollow cavity walled by a substantially solid material that may comprise holes 105; and buoyant-section 140 may be buoyant allowing FI 100 to float. The holes 105 may be positioned in locations that allow water to enter and exit the cavity of buoyant-section 140 in response to tilting forces applied by climbing users upon FI 100. The dynamically changing of water quantity in FI 100 may facilitate in balancing the floating of FI 100 in a substantially upright position, where the weight of the water captured in buoyant-section 140 at any given moment may facilitate in preventing FI 100 from turning over.

While the description below contains many specifications, these should not be construed as limitations on the scope of the invention, but rather as exemplifications of the preferred embodiments. Those skilled in the art will envision other possible variations that are within its scope. Accordingly, the scope of the invention should be determined not by the embodiment illustrated, but by the appended claims and their legal equivalents.

Reference in the specification to "one embodiment", "an embodiment", "some embodiments" or "other embodiments" means that a particular feature, structure, or characteristic described in connection with the embodiments is included in at least one embodiments, but not necessarily all embodiments, of the inventions. It is understood that the phraseology and terminology employed herein is not to be construed as limiting and are for descriptive purpose only.

The principles and uses of the teachings of the present invention may be better understood with reference to the accompanying description, figures and examples. It is to be understood that the details set forth herein do not construe a limitation to an application of the invention. Furthermore, it is to be understood that the invention can be carried out or practiced in various ways and that the invention can be implemented in embodiments other than the ones outlined in the description below.

It is to be understood that the terms "including", "comprising", "consisting" and grammatical variants thereof do not preclude the addition of one or more components, features, steps, or integers or groups thereof and that the terms are to be construed as specifying components, features, steps or integers. The phrase "consisting essentially of", and grammatical variants thereof, when used herein is not to be construed as excluding additional components, steps, features, integers or groups thereof but rather that the additional features, integers, steps, components or groups thereof do not materially alter the basic and novel characteristics of the claimed composition, device or method.

If the specification or claims refer to "an additional" element, that does not preclude there being more than one of the additional element. It is to be understood that where the claims or specification refer to "a" or "an" element, such reference is not be construed that there is only one of that element. It is to be understood that where the specification states that a component, feature, structure, or characteristic "may", "might", "can" or "could" be included, that particular component, feature, structure, or characteristic is not required to be included.

Where applicable, although state diagrams, flow diagrams or both may be used to describe embodiments, the invention is not limited to those diagrams or to the corresponding descriptions. For example, flow need not move through each illustrated box or state, or in exactly the same order as illustrated and described.

Methods of the present invention may be implemented by performing or completing manually, automatically, or a combination thereof selected steps or tasks. The term "method" refers to manners, means, techniques and procedures for accomplishing a given task including, but not limited to, those manners, means, techniques and procedures either known to, or readily developed from known manners, means, techniques and procedures by practitioners of the art to which the invention belongs. The descriptions, examples, methods and materials presented in the claims and the specification are not to be construed as limiting but rather as illustrative only.

Meanings of technical and scientific terms used herein are to be commonly understood as by one of ordinary skill in the art to which the invention belongs, unless otherwise defined. The present invention can be implemented in the testing or practice with methods and materials equivalent or similar to those described herein.

Any publications, including patents, patent applications and articles, referenced or mentioned in this specification are herein incorporated in their entirety into the specification, to the same extent as if each individual publication was specifically and individually indicated to be incorporated herein. In addition, citation or identification of any reference in the description of some embodiments of the invention shall not be construed as an admission that such reference is available as prior art to the present invention.

FIG. 1 schematically illustrates an isometric top view of a floating island (FI) 100, according to some embodiments of the present invention. FI 100 may be an asymmetric or a symmetric three-dimensional shape with a saddle-shaped curve 110 to facilitate users in climbing FI 100. FI 100 may be made of floating materials and comprise upper holes 105 that may further facilitate the climbing of users on FI 100, as well as to allow water to enter and exit the cavity of weight-section 130. As is entirely apparent from FIGS. 1, 3 and 4, the bottom may comprise the widest part of the floating island.

Figure 2:
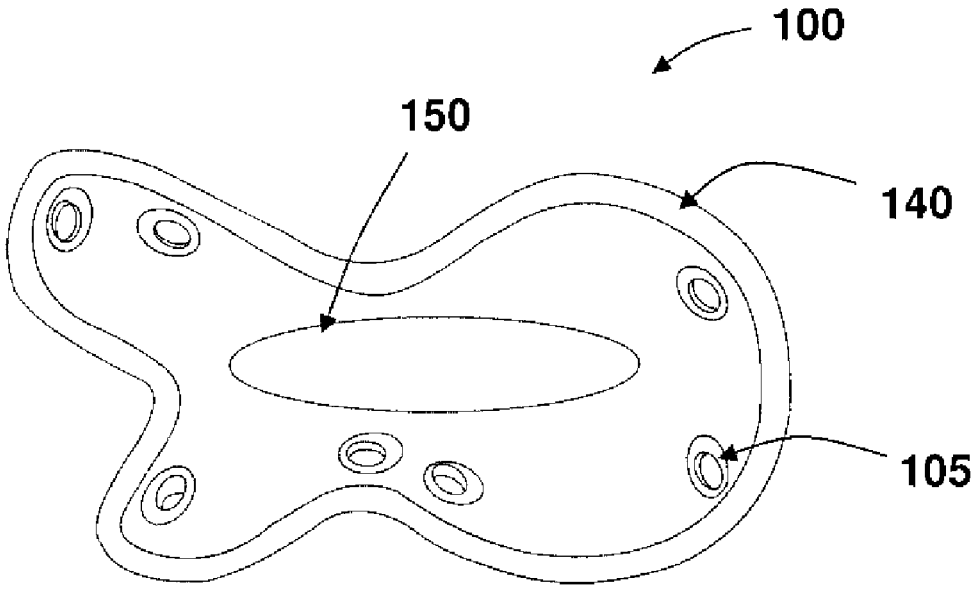

FIG. 2 schematically illustrates a bottom view of FI 100, according to some embodiments of the present invention. The circumferential framing of FI's 100 bottom may be substantially flat. At least part of the middle area of FI 100 may be sunk inwardly creating a niche 150. The bottom of FI 100 may comprise lower holes 105.

Figure 3:
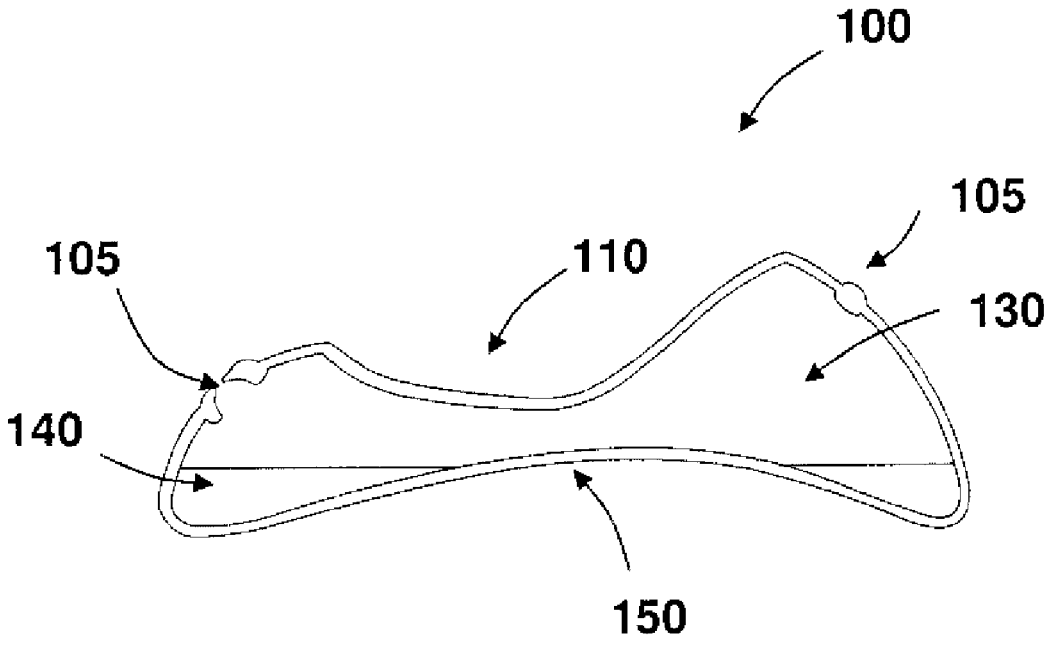
FIG. 3 is a side view of a cross-section of a floating island, according to some embodiments of the present invention.

FIG. 3 schematically illustrates a side view cross section of floating island (FI) 100, according to some embodiments of the present invention. The weight-section 130 of FI 100 may be hollow inside, where upper holes 105 allow water to enter the cavity of weight-section 130 to facilitate in stabilizing FI 100 and keeping it from turning upside down while the players climb and play on FI 100.

According to embodiments of the present invention, buoyant-section 140 may be made of any known in the art buoyant material or materials and of any known in the art techniques enabling floating of the FI 100. For example, buoyant-section 140 may be made of polystyrene, balloon (containing any kind of floating gas such as air. Helium and the like), plastic etc.

Weight-section 130 may contain various quantities of water depending on the balancing that FI 100 needs to maintain according to the users' appliance of forces and the direction of the forces. Holes 105 may enable adjusting the quantities of water contained inside the cavity of weight-section 130 that are required for the maintaining of FI's 100 balance—preventing FI 100 from turning over while the users climb or apply any other reasonable tilting or turning forces upon FI 100. Additionally, FI 100 may enable a substantially constant quantity of water to be in weight-section 130 where the changes of water quantities in the cavity may vary above a substantially constant minimum quantity.

Figure 4:
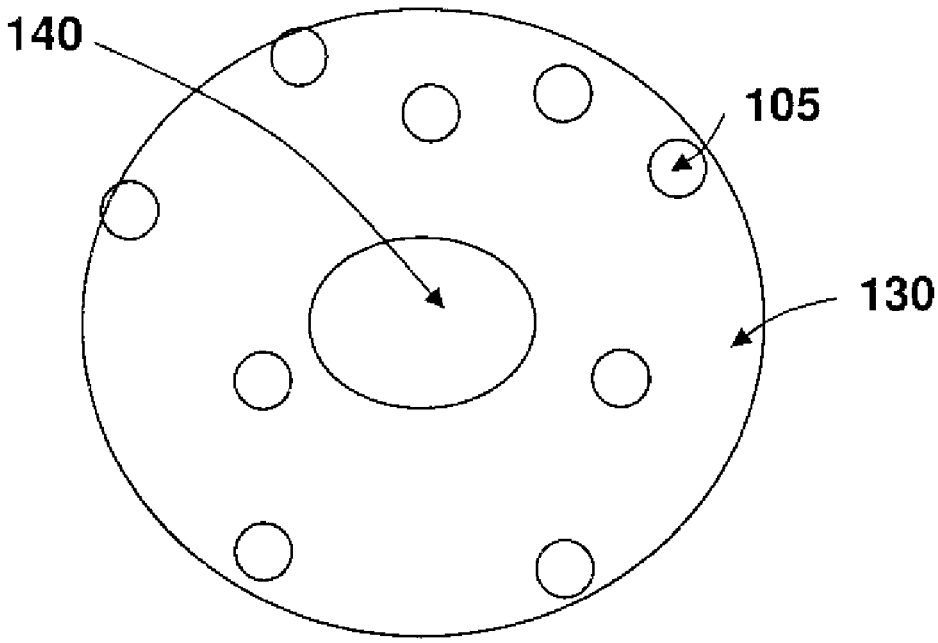
FIG. 4 is a bottom view of a floating island, according to alternative embodiments of the present invention.

FIG. 4 schematically illustrates a bottom view of a FI 100, according to alternative embodiments of the invention. Weight-section 130 may be a tire-shaped ring that comprises holes 105, where buoyant-section 140 may be seated in the middle of the tire of weight-section 130. According to embodiments of the invention the buoyant-section 140 may be a ball-shaped rounded balloon containing floating gas (such as air, for example). The users may climb the FI 100 where the rounded shape of buoyant-section 140 may also facilitate in balancing the position of FI 100. Holes 105 in weight-section 130 may create another type of a dynamic weight responding to forces applied by the users.

Additionally, the weight-section may comprise climbing-members which may facilitate the users in climbing over the FI 100. The climbing-members may be, for example at least some of the holes 105 and/or protrusions, and like.

While the invention has been described with respect to a limited number of embodiments, these should not be construed as limitations on the scope of the invention, but rather as exemplifications of some of the preferred embodiments. Those skilled in the art will envision other possible variations, modifications, and applications that are also within the scope of the invention. Accordingly, the scope of the invention should not be limited by what has thus far been described, but by the appended claims and their legal equivalents.

What is claimed is:

1. A device for a body of water, comprising:

a floating island having a curve, the floating island also having a bottom, the bottom being a widest part of the floating island;

a buoyant section affixed to the bottom;

a three-dimensional irregular dynamic weight section defined by and including an enclosed wall of substantially solid material that defines an enclosed cavity, the enclosed wall having holes through said wall distributed around said floating island including a plurality of upper holes in the dynamic weight section of the floating island and a plurality of lower holes in the bottom of the floating island, the floating island structured so that when placed in a body of water the curve normally projects out of the body of water to provide a floating island surface capable of supporting users climbing thereon while the fixed buoyant section is submerged in the body of water and the dynamic weight section is capable of supporting users climbing on the floating island surface while the dynamic weight section is above the buoyant section; and whereby in response to tilting forces imposed on the floating island by users climbing on or off the top surface of the floating island water can enter into and exit from an interior space of said floating island through at least some of the holes and thereby dynamically balance the floating island and preventing upsetting of the floating island.

2. The floating island of claim 1, wherein the curve includes a saddle shaped curve.

3. The floating island of claim 1, wherein the floating island is asymmetrical.

4. The floating island of claim 1 wherein the buoyant section is fixed to the bottom about a periphery of the bottom.

5. The floating island of claim 1, wherein the dynamic weight section has climbing members to facilitate users climbing on the floating island.

6. The floating island of claim 5, wherein the holes that allow water to enter the main body are also the climbing members.

* * * * *